United States Patent [19]

Celani

[11] Patent Number: 4,753,149

[45] Date of Patent: Jun. 28, 1988

[54] BRAIDING MACHINE

[75] Inventor: Jeffrey A. Celani, Inglewood, Calif.

[73] Assignee: Northrop Corporation, Hawthorne, Calif.

[21] Appl. No.: 6,461

[22] Filed: Jan. 15, 1987

[51] Int. Cl.[4] ..... D04C 3/12; D04C 3/40

[52] U.S. Cl. ..... 87/29; 87/14; 87/19; 87/31

[58] Field of Search ..... 87/14, 15, 18–20, 87/28–31, 41

[56] References Cited

U.S. PATENT DOCUMENTS 1,322,590 11/1919 Lewis ..... 87/31

2,093,313 9/1937 Diamond ..... 87/31

FOREIGN PATENT DOCUMENTS 23913 of 1912 United Kingdom ..... 87/31

*Primary Examiner*—John Petrakes

*Attorney, Agent, or Firm*—Terry J. Anderson; Robert B. Block

[57] ABSTRACT

An apparatus for forming a braided covering over an article, such as a wire harness, which is continuously operable for forming a braided covering throughout the entire length of the wire harness. A sensor, operable in response to movement of the material being utilized for forming the braided covering, is actuable to control the operation of a mechanism for advancing the braided harness out from the zone of braiding operation to permit the continuous braiding of the harness throughout the length thereof. A detector, operable in response to the presence of deformations in the braided harness, controls operation of the advancing mechanism and braiding operation to detect, for example, breaks in the threaded material being supplied for the braiding operation.

20 Claims, 1 Drawing Sheet

BRAIDING MACHINE

BACKGROUND OF THE INVENTION

This invention relates in general to braiding machines used to braid a covering over an article such as a wiring harness and, in particular, to a continuous operable automatic braiding machine which automatically periodically advances the finished braided product after a braided covering has been formed thereabout enabling continuous braiding uninterrupted by the necessity of manually advancing the finished braided product in order to continue the covering operation.

In fabricating wiring harnesses for routing to such things as instrument panels, it is highly desirable to cover the wire harness with a braided covering in order to protect and route the wiring to a desired location. To this end, such wire harnesses are passed through a mechanical braiding machine, such as a Model No. E10 Series 48 braider available from New England Butt Co., which functions to mechanically braid a covering over the wire harness. While such a mechanical braiding machine is preferable to a manual braiding operation, when utilizing such machines to produce a large diameter braid, the braiding operation must often be frequently interrupted on a regular basis in order to move the braided wire harness to permit further covering.

For example, after the braiding machine is started and a portion of the wire harness is braided, approximately six inches, the braiding machine must be stopped in order to advance the braided wire harness to permit further braiding. Upon advancing the braided harness, the braiding machine is restarted and the braiding operation permitted to continue until another approximately six-inch braid is formed. At that time the braiding is again interrupted, the braided harness again advanced and the machine again restarted for further braiding. This intermittent operation continues to incrementally cover the wire harness with a braid until the harness braid is completed.

The present invention eliminates such intermittent operation, and permits the braiding machine to operate continuously by automatically advancing the braid covered wire harness as the harness is covered by the braid.

SUMMARY OF THE INVENTION

It is, therefore, an object of this invention to improve mechanical braiding machines.

Another object of this invention is to permit the continuous uninterrupted operation of a mechanical braiding machine for covering an article fed therethrough throughout the entire length thereof.

A further object of this invention is to periodically advance an article being covered by a braid as the article is covered to permit the continuous and uninterrupted braiding thereof.

Still another object of this invention is to control the periodic advancement of an article being covered by a braid in response to the positioning of the materials forming the braid relative to the article being braided.

These and other objects are attained in accordance with the present invention wherein there is provided an apparatus for forming a braided covering over an article, suc as a wire harness, which is continuously operable for forming a braided covering throughout the entire length of the wire harness. A sensor, operable in response to movement of the material being utilized for forming the braided covering is actuable to control the operation of a mechanism for advancing the braided harness out from the zone of braiding operation to permit the continuouos braiding of the harness throughout the length thereof.

DESCRIPTION OF THE DRAWINGS

Further objects of the invention together with additional features contributing thereto and advantages accruing therefrom will be apparent from the following description of a preferred embodiment of the invention which is shown in the accompanying drawings with like reference numerals indicating corresponding parts throughout, wherein.

DESCRIPTION OF A PREFERRED EMBODIMENT

Figure 1:
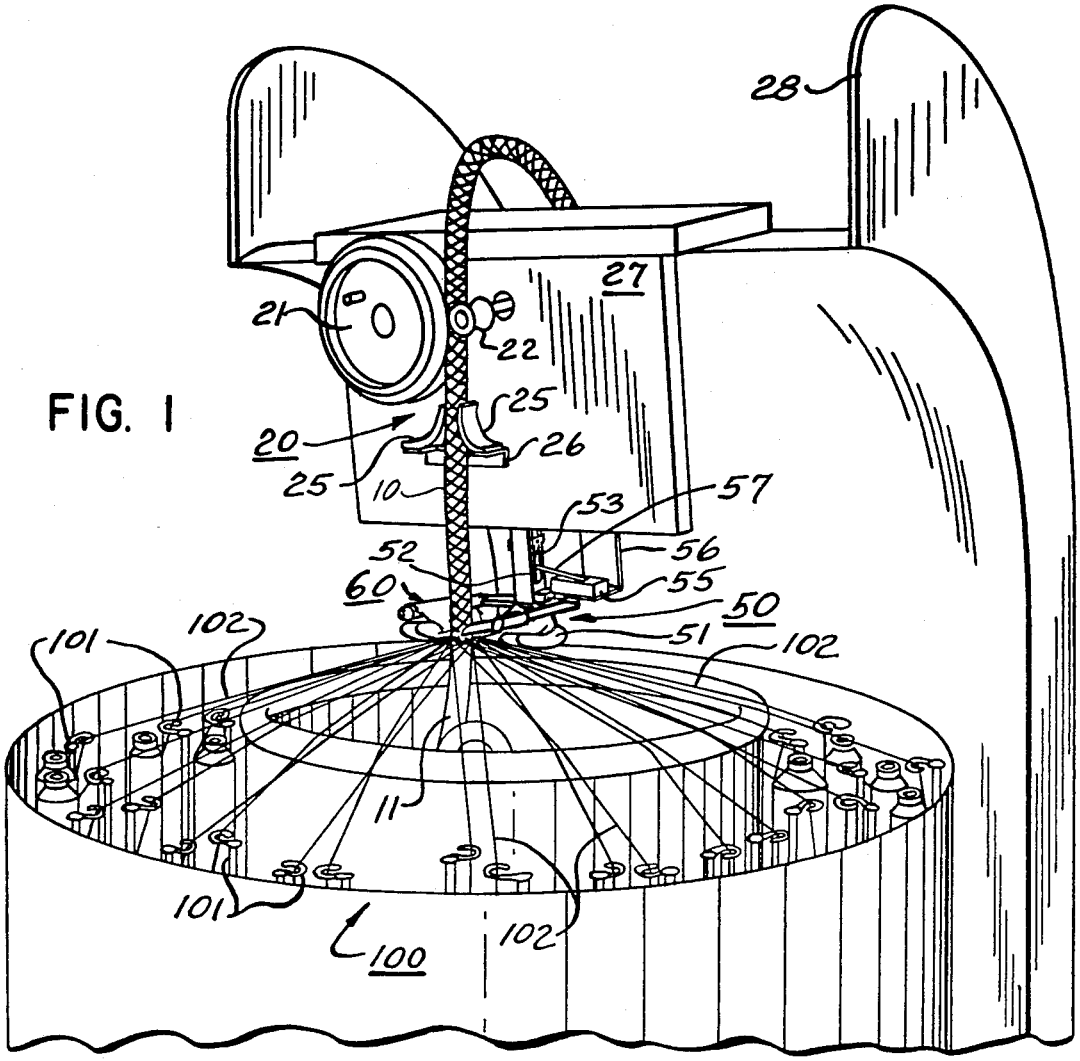
FIG. 1 is a frontal perspective view of a mechanical braiding machine forming a braided covering over a wiring harness and incorporating the invention for controlling the continuous and uninterrupted braiding operation thereof.
Figure 3:
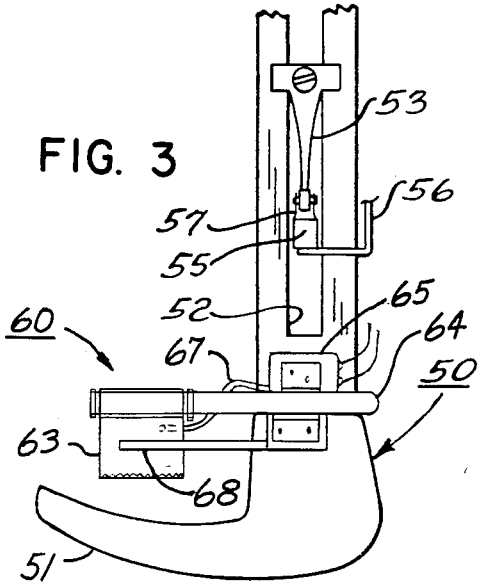
FIG. 3 is a side view of the sensor foot illustrated in FIG. 2 taken in the direction of lines 3—3.
Figure 2:
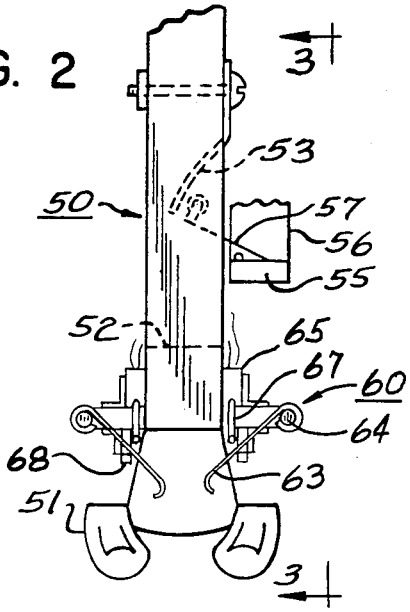
FIG. 2 is an enlarged frontal view of a sensor foot used in controlling the operation of a mechanism for advancing the braid-covered wiring harness.

Referring now to FIG. 1, there is illustrated a mechanical braiding machine 100 for braiding a covering 10 over an article such as a wiring harness 11. Braiding machines 100 those of the type illustrated in FIG. 1 are available from New England Butt Co. Model E10 Series 48 braiding machine. Although the disclosure of the structure and operational details of the mechanical braiding machine 100 are not necessary for an understanding of this invention, which is not intended to be limited in its use to any particular mechanical braiding machine, all such mechanical braiding machines will include a plurality of bobbins 101 which utilize threaded materials 102 to braid the covering 10 over an article such as the wire harness 11. As previously described, heretofore the operation of a braiding machine may not have been continuous. In such arrangements it is typically necessary to interrupt the braiding operation after a portion of a wiring harness had been covered by a braid, to continuously advance the braided harness while maintaining a uniform braid thickness.

To enable the mechanical braiding machine 100 to operate continuously even when producing a large diameter braid an advancing mechanism 20 is provided to periodically move the braid-covered wiring harness 10 upwardly to permit the bobbins 101 to continuously braid a covering over the unbraided harness 11. The advancing mechanism 20 includes a motor-driven wheel 21 rotatably and controllably driven by an electric motor, not shown, and an idler roller 22 which is biased into contact with the motor-driven roller 21, or an article such as the braid-covered wiring harness passing therebetween. The idler roller 22 is spring-loaded to provide the biasing force, and in combination with a high coefficient of friction material placed on the outer surface of one or both of the wheels 21 and 22, functions to advance the braid- covered harness 10 upwardly whenever the motor-driven wheel 21 is rotatably driven.

In order to ensure that the completed or braid-covered harness 10 does not slip downward, a pair of spring-loaded curved plates 25 are positioned adjacent to the rollers 21 and 22 to form a spring-loaded throat permitting the braid-covered harness 10 to be readily moved upward through the throat so formed, but imposing a pinching action on the harness 10 if moved in an opposite direction to prevent any downward movement. The spring-loaded curved plates 25 are pivotally supported for movement toward one another on a bifurcated positioning bracket 26 carried by a generally L-shaped support bracket 27 which positions the advancing mechanism 20 above the braiding machine 100 and adjacent to a slide 28 over which the completed braid-covered wiring harness 10 passes after being advanced above the advancing rollers 21 and 22.

Operation of the electric motor utilized to power roller 21 for advancing the braid-covered wiring harness 10 is controlled by means of a sensor assembly 50 which includes a bifurcated sensor foot 51 having a slotted shank portion 25 carrying a switch actuator 53. A motor switch 55 is carried by a bracket 56 secured to the L-shaped support bracket 27, and has a contact arm 57 positioned to be actuated by the switch actuator arm 53 carried on the sensor foot 51. The sensor foot 51 is supported from the L-shaped support bracket 27 for free vertical movement sufficient to rest on the threaded materials 102, passing from the bobbins 101 to form the braided wiring harness covering, and to move vertically therewith.

The sensor foot 51 is formed with the slotted shank 52 in which the switch actuator arm 53 is adjustably positioned for movement in a vertical direction along the slot 52. To this end an adjusting screw 54, to which the actuator arm 53 is secured, extends through the slot in the sensor foot 51 to clamp the switch actuator arm 53 in the desired vertical position along the slot for controlling the position of the actuator arm 53 relative to the switch contact arm 57 of the motor switch 55. In this manner, the downward vertical movement of the sensor foot 51, resting on the threaded material 102 from which the braided covering is formed is limited for causing the motor driven roller 21 to be actuated.

As shown in FIG. 1, the bifurcated sensor foot 51 is positioned with the braid-covered wiring harness 10 passing between the bifurcated portion, and the sensor foot 51 resting on the threaded material 102 being used to form the braided covering. During the braiding operation, as the braid 10 is formed further down on the wiring harness 11, the sensor foot 51 will continuously lower with the unbraided materials 102. When the braided covering 10 is being formed at a predetermined vertical point, the actuator arm 53 will contact the switch contact arm 57, closing the contacts of motor switch 55 and actuating the electric motor to drive roller 21. As previously described, rotary movement of the motor-driven roller 21 will cause the braid-covered wiring harness 10 to be pulled upwardly between the motor-driven roller 21 and the springloaded idler roller 22. The harness 10 will be pulled through the spring-loaded throat formed between the two curved plates 25, and pass upwardly and down over the chute or slide 28.

When the braid-covered harness 10 is moved upwardly, the point at which the braid is being formed by the unbraided materials 102 will correspondingly be moved upward thereby raising the sensor foot 51. This upward movement of the sensor foot 51 will move the actuator arm 53 out from engagement with the switch contact arm 57 of motor switch 55 thereby terminating operation of the electric motor coupled to the motor-driven roller 21. This periodic cycling of the advancing rollers will continue as a cover is braided over the wiring harness 11 until such time as the entire wiring harness has been braided. It has been found that when the actuator arm 53 is positioned along the vertical slot 52 to energize the motor switch 55 upon the formation of approximately ¾" to approximately 1" of braid covering, the braid 10 so formed is of a uniform thickness and tension on the braid is reduced during advancement. While the intermittent operation of the motor-driven roller 21 can be set for longer lengths of braid formation, it has been found that the larger braid lengths so formed may have a non-uniform braid thickness.

During braid formation, it is sometimes occasioned that the threaded material 102 carried on the bobbins 101 breaks. In that event, the braid covering 10 will not be uniform, and it becomes desirable to shut down the braid advancing mechanism 20 and the braiding machine 100 itself. To this end, the mechanical braiding machine 100 is provided with a broken-thread detecting mechanism 60 actuated by the formation of an irregular braid itself which occurs when the threaded material 102 is broken.

The broken-thread detecting mechanism 60 includes a pair of actuator arms 63, each of which is formed as a free-swinging band pivotally supported on an arm of a U-shaped bracket 64. The supporting bracket 64 is carried by the sensor assembly 50 at a position adjacent to, and above, the bifurcated sensor foot 51. The arms of bracket 64 are positioned on either side of the braid-covered wiring harness 10, and in this manner the pivotally supported actuator arms 63 are positioned adjacent to the braided harness passing therebetween.

The actuator arms 63 are positioned closely adjacent to, but out of contact with, the braided harness 10 when the harness is covered with a braid having a proper thickness. A pair of adjustable stop pins 68 are supported from and positioned along the bracket 64 to hold the free-swinging actuator arms 63 in the desired spatial position relative to the braid covered harness 10 passing between the actuator arms.

A pair of switch contact arms 67 of a microswitch 65 are carried upon the bracket 64 in a position to be actuated by the pivotal movement of either or both actuator arms 63. In this manner, if threaded material 102 from bobbins 101 breaks, the resulting braid develops a bulge. This bulge in the braided harness 10 will contact the actuator arms 63 when the advancing mechanism 20 is actuated. Upon such contact, one or both actuator arms 63 will be pivoted against the switch contact arm(s) 67 and microswitch 65 will interrupt further operation of the advancing mechanism 20 and shut down operation of the braiding machine 100.

While the invention has been described in the specification and illustrated in the drawings with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the description of the appended claims.

I claim:

1. In a braiding machine for intertwining a threaded material about an article such as a wiring harness for forming a braided covering thereabout, the improvement comprising article advancing means carried by the braiding machine in a position to engage an article after having a braided covering formed thereabout through operation of said braiding machine, said article advancing means operable in response to the actuation thereof for intermittently advancing a braid covered article engaged therewith out from said braiding machine, and sensor means operatively connected to said article advancing means for controlling the intermittent operation thereof in response tot he formation of a braided covering about an article passing through said braiding machine.

2. The braiding machining as defined in claim 1 wherein said sensor means includes means contacting the threaded material from which a braided covering is formed and movable in response to the movement of the threaded material during formation of a braided covering aboout an article for actuating said article advancing means in response thereto.

3. The braiding machine as defined in claim 2 wherein said means contacting the threaded material comprises a bifurcated sensor foot supported on the threaded material from which a braided covering is formed and positioned adjacent the point whereat the threaded material is intertwined for forming the braided covering with the braid covered article passing between the bifurcated portions thereof.

4. The braiding machine as defined in claim 3 further including a sensor actuator arm carried by said bifurcated sensor foot, and a motor switch positioned adjacent said sensor arm and having a switch contact arm engageable therewith for actuating said switch in response to movement of said sensor actuator arm.

5. The braiding machine as defined in claim 4 wherein said means contacting the threaded material includes a slotted portion and said sensor actuator arm is vertically positionable within said slotted portion.

6. The braiding machine as defined in claim 4 wherein operation of said article advancing means advances the braid covered article approximately six inches.

7. The braiding machine as defined in claim 1 wherein said article advancing means comprises a motor driven wheel and a spring-loaded idler wheel spring biased into engagement with said motor driven wheel on an article passing between said motor driven wheel and said idler wheel.

8. The braiding machine as defined in claim 7 further including a pair of spring-biased curved plates positioned adjacent to said motor driven wheel and said spring-loaded idler wheel for forming a retaining throat through which a braided covering may be advanced in a first direction by said article advancing means but prevented from moving in a reverse direction.

9. The braiding machine as defined in claim 8 wherein said motor driven wheel has a high coefficient of friction surface for engaging the braid covered article.

10. The braiding machine as defined in claim 8 wherein said spring-loaded idler wheel has a high coefficient of friction surface for engaging the braid covered article.

11. The braiding machine as defined in claim 1 further including detecting means for detecting deformations in the braided covering formed on the braid covered article.

12. The braiding machine as defined in claim 11 wherein said detecting means includes at least one actuator arm positionable adjacent to and spaced from the braid covered article, said detecting arm being movable into an actuating position upon engagement with a protrusion of said braid covered article extending outwardly therefrom a sufficient distance to contact and move said actuator arm.

13. The braiding machine as defined in claim 12 wherein said at least one actuator arm is supported for pivotable movement upon contact with a protrusion extending outwardly from the braid covered article a sufficient distance to contact said actuator arm and is carried by said sensor means at a position to be engaged by a protrusion prior to the protrusion engaging said article advancing means.

14. The braiding machine as defined in claim 13 including two actuator arms spaced in parallel relative to each other with the braid covered article passing therebetween.

15. In a braiding machine of the type in which a plurality of bobbins supporting thread material are arranged in a generally circumferential manner for articulation relative to an article such as a wiring harness for forming a braided covering thereabout, the improvement comprising article advancing means associated with said braiding machine and positioned to engage an article about which a braided covering is formed and for controllably advancing said engaged braid covered article from said braiding machine and the location at which the braid thereabout is formed, sensing means for contacting thread material from which a braided covering is formed as it is articulated from said bobbins and into the braided location about said article and movable in response to movement of said contacted thread material as said article is advanced by said advancing means to sense such advancement, and means operable in response to movement of said sensing means and contacted thread material for controlling said article advancing means and the advancement of such article.

16. The braiding machine as defined in claim 15, further including, second sensing means for contacting a braided article for movement in response to irregularities in the braided covering about said article and means operable in response to movement of said second sensing means for controlling said article advancing means in response to detected irregularities in the braided covering about said article.

17. The braiding machine as defined in claim 16, further including, a pair of detent members engaging opposite sides of an advancing braid covered article and resiliently biased thereagainst to permit movement of such article in the direction of said article advancing means but inhibiting movement of such article in the direction opposite article advancement.

18. In a braiding machine of the type in which a plurality of bobbins supporting thread material are arranged in a generally circumferential manner for articulation relative to an article such as a wiring harness for forming a braided covering thereabout, the improvement comprising article advancing means associated with said braiding machine and positioned to engage an article about which a braided covering is formed and for controllably advancing said engaged braid covered article from said braiding machine and the location at which the braid thereabout is formed, first sensing means for contacting thread material from which a braided covering is formed as it is articulated from said bobbins and into the braided location about said article, said first sensing means being movable on said braiding machine in response to movement of said contacted thread material as said article is advanced by said advancing means, to sense such advancement, means operable in response to movement of said first sensing means for controlling said article advancing means and the advancement of such article, second sensing means supported for movement with said first sensing means for contacting a braided article and positioned for movement in response to irregularities in the braided covering about said article and means operable in response to movement of said second sensing means for controlling said article advancing means in response to detected irregularities in the braided covering about said article.

19. The braiding machine as defined in claim 18, further including, a pair of detent members engaging opposite sides of an advancing braid covered article and resiliently biased thereagainst to permit movement of such article in the direction of said article advancing means but inhibiting movement of such article in the direction opposite article advancement.

20. In a braiding machine of the type in which a plurality of bobbins supporting thread material are arranged in a generally circumferential manner for articulation relative to an article such as a wiring harness for forming a braided covering thereabout, the improvement comprising article advancing means associated with said braiding machine including an electrically driven drive wheel positioned to engage an article about which a braided covering is formed and for controllably advancing said engaged braid covered article from said braiding machine and the location at which the braid thereabout is formed, and an idler roller resiliently biased in the direction of said drive wheel to frictionally support said engaged braid covered article therebetween, a pair of arcuately shaped detent members engaging opposite sides of an advancing braid covered article and resiliently biased thereagainst to permit movement of such article in the direction of said article advancing means but inhibiting movement of such article in the direction opposite article advancement, a bifurcated sensor foot for positioning about a braid covered article in the bifurcation thereof and for contacting thread material from which a braided covering is formed as it is articulated from said bobbins and into the braided location about said article, said sensor foot being movable on said braiding machine in response to movement of said contacted thread material as said article is advanced by said advancing means to sense such advancement, electrical control means operable in response to movement of said sensor foot for controlling said electrically driven drive wheel and the advancement of such article, a pair of actuator arms pivotally supported on said sensor foot for movement with said sensor foot and for contacting a braided article for relative movement about said pivotal supports in response to irregularities in the braided covering about said article and electrical control means operable in response to movement of said actuator arms for controlling said article advancing means in response to detected irregularities in the braided covering about said article.

* * * * *